United States Patent [19]

Kallmes

[11] Patent Number: 4,838,996

[45] Date of Patent: Jun. 13, 1989

[54] HYDROFOIL BLADE FOR PRODUCING TURBULENCE

[75] Inventor: Otto J. Kallmes, Danvers, Mass.

[73] Assignee: M/K Systems Inc., Danvers, Mass.

[21] Appl. No.: 150,206

[22] Filed: , Jan. 29, 1988

[51] Int. Cl.[4] ..... D21F 1/48; D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 1,781,928 | 11/1930 | Liebeck | 162/351 |
| 2,928,465 | 3/1960 | Wrist | 162/352 |
| 3,497,420 | 2/1970 | Clark | 162/352 |
| 3,573,159 | 3/1971 | Sepall | 162/208 |
| 3,874,998 | 4/1975 | Johnson | 162/352 |
| 3,922,190 | 11/1975 | Cowan | 162/352 |
| 4,123,322 | 10/1978 | Hoult | 162/352 |
| 4,140,573 | 2/1979 | Johnson | 162/209 |
| 4,420,370 | 12/1983 | Saad | 162/352 |
| 4,687,549 | 8/1987 | Kallmes | 162/352 |

FOREIGN PATENT DOCUMENTS

| | | | |
|---|---|---|---|
| 111795 | 6/1964 | Czechoslovakia . | |
| 78406 | 5/1983 | European Pat. Off. | 162/352 |
| 2108489 | 9/1971 | Fed. Rep. of Germany . | |
| 1119796 | 6/1986 | Japan | 162/348 |
| 457764 | 2/1975 | U.S.S.R. . | |
| 461195 | 3/1975 | U.S.S.R. | 162/352 |

OTHER PUBLICATIONS

"Drainage at a Table Roll"-G. I. Taylor, Pulp & Paper Mag of Canada Convention Issue 1956, pp. 267-276.

"Drainage at a Table Roll and a Foil"-G. I. Taylor and First Discussion Session-Second Symposium on Hydrodynamics of the Fourdrinier Wet End-CPPA-TS, 44, 1958, pp. 284-292.

"New Huyflo Blades Reduced Drag-Load (Like the Computer Said They Would", 1972.

American Papermaker, "Initial Operating Experience with the Multi-Foil Blade"-Otto J. Kallmes (Nov. 1987), pp. 46-48.

Das Papier, "Cascadefoil*-ein neues Formations-und Entwässerungselement", W. Kufferath et al, pp. 1-12.

*Primary Examiner*—Karen Hastings

*Attorney, Agent, or Firm*—Witherspoon & Hargest

[57] ABSTRACT

A hydrofoil blade for use in a paper making machine wherein a plurality of variously angulated surfaces is provided for producing turbulence having controllable scale and intensity while independently controlling the rate of dewatering.

11 Claims, 3 Drawing Sheets

HYDROFOIL BLADE FOR PRODUCING TURBULENCE

BACKGROUND OF THE INVENTION

1. Field of the Invention

This invention relates to a hydrofoil blade for use in a paper making machine of the type wherein hydrofoil blades are positioned beneath a forming medium and extended in the cross machine direction relative to the forming medium for draining water through the forming medium from a paper web being formed on the forming medium and for forming the paper web.

2. Description of the Prior Art

In the typical Foundrinier papermaking machine, an aqueous suspension of fibers, called the "stock" is flowed from a headbox onto a traveling Fourdrinier wire or medium, generally a woven belt of wire and/or synthetic material, to form a continuous sheet of paper or paper-like material. In this connection, the expression "paper or paper-like material" is used in a broad or generic sense and is intended to include such items as paper, kraft, board, pulp sheets and non-woven sheet-like structures. As the stock travels along the Fourdrinier wire, formation of a paper web occurs, as much of the water content of the stock is removed by draining. Water removal is enhanced by the use of such well-known devices as hydrofoil blades, table rolls and/or suction devices. This invention relates to hydrofoil blades.

The hydrofoil blades used in papermaking perform two functions. The first function is to create a vacuum pulse over the downward inclined face of the hydrofoil blade. This pulse removes a portion of the white water from the lower side of the stock which lays upon the forming medium and causes fibers to be laid down and formed into a web. The amount of such water removal and web formation over a given hydrofoil blade is small, and therefore a considerable number of blades is required to form all of the fibers in the stock suspension into a two dimensional web. For example, the use of ten to fifty hydrofoil blades is not uncommon. In other words, the sheet forming process is a step-by-step filtration process as the forming medium travels over the hydrofoil blades, with some of the fibers in the lower portion of the stock suspension over the partially-formed web being added to the web at each successive foil blade. The average net change in fiber concentration or consistency of this process ranges from the headbox consistency, which is usually about 0.4 percent to about 1 percent, up to about 2.5 percent.

The second function of a hydrofoil blade is to maintain the fibers which are still is suspension throughout the forming process in an as-well-as dispersed condition as possible; i.e., in a deflocculated condition. This function is extremely important as fibers in the 0.5–2.0 percent consistency range have a strong tendency to flocculate into clumps on their own in a matter of milliseconds once the fiber dispersive forces have decayed. This flocculation causes the final paper to be highly non-uniform or flocculated in appearance.

The realization in the 1970's that papermaking stocks at commercially used consistencies reflocculate in milliseconds once floc dispersing forces on the papermaking machine decay has led to an array of devices to deliver such forces into the stock remaining to be formed into a web throughout the sheet forming process. The two key requirements of these floc dispersing forces are (1) that their size or scale is sufficiently small so that they only break up the fiber flocs, but do not disrupt the overall large scale mass of the suspension, and (2) that their intensity is sized likewise.

Both the intensity and scale of the turbulence generated by conventional foil blades of the type first described by Wrist, US Pat. No. 2,948,465 are a function of the square of both their angle to the forming fabric and the speed of the papermaking machine. As a result, the turbulence they generate is rarely optimum on papermachines producing a variety of grades over a wide speed range.

A further disadvantage of such conventional foils is that their dewatering rate and the intensity of the turbulence they generate are directly related to each other. That is, if more turbulence is required and a large foil angle is employed, then more dewatering is invariably obtained as well. Such an effect is often undesirable, especially during the early stages of sheet formation where considerable redispersion of the stock prior to sheet formation is often highly desirable. This is usually the case, for example, with older, overloaded headboxes delivering suspensions which are poorly dispersed and contain large scale eddy currents.

One device developed recently in an effort to overcome these shortcomings of such conventional foils is the multi-step foil blade described in Kallmes, US Pat. No. 4,687,549. Such foils dewater stock in a controllable manner without generating any turbulence whatsoever. Its use in a redispersing system relies on the continuous cross machine direction shear generated by the phase-changing ridges produced either by a serrated slice or a formation shower to keep the stock dispersed throughout the sheet-forming process. This cross machine direction shear acts on the stock remaining to be formed into a sheet in a manner similar to the well-known shake of slow running papermachines.

One of the key characteristics of a sheet forming process employing a serrated slice or a formation shower to keep the stock dispersed and the multi-step foil described in US Pat. No. 4,687,549 to provide turbulence-free controlled dewatering only is that it separates these two functions. That is, the pressure of the formation shower controls the intensity of the cross machine direction shear generated while the overall angle of inclination of the multi-step foil blade to the forming fabric controls the rate of dewatering.

The cross machine direction shear generated by the phase changes of the ridges produced by either a serrated slice or a formation shower are highly effective in improving the formation quality of virtually all types of paper. However, both serrated slices and formation showers have certain undesirable characteristics. Serrated slices are fixed structures which cannot be adjusted at will, and their design, like that of foil blades, is not optimum at all machine speeds on multi-grade papermachines. Formation showers also have their limitations in that, for example, their nozzles often plug, and they tend to catch stock sprayed off the forming fabric which can build up fiber clumps on them and then drop off to cause sheet breaks. Thus, there are many papermakers who shy away from using these devices for practical operating reasons.

It is desirable to overcome the foregoing shortcomings by providing a multi-step foil blade which produces floc-dispersing turbulence of controllable scale and intensity, and simultaneously independently controls the rate of dewatering.

SUMMARY OF THE INVENTION

This invention achieves these and other objects by providing a hydrofoil blade for use in a paper making machine of the type wherein hydrofoil blades are positioned beneath a forming medium and extended in the cross machine direction relative to the forming medium for draining water through the forming medium while a paper web is being formed on the forming medium and for forming the paper web. The hydrofoil blade comprises a forming medium bearing surface having a leading edge, a lower surface spaced from the forming medium bearing surface, and at least one dewatering surface diverging downward towards the lower surface from a respective of at least one crease line. The dewatering surface and/or other downstream surfaces are configured having specific angular orientation as disclosed herein for producing floc-dispersing turbulence having controllable scale and intensity while independently controlling the rate of dewatering.

DESCRIPTION OF THE PREFERRED EMBODIMENTS

Figure 1:
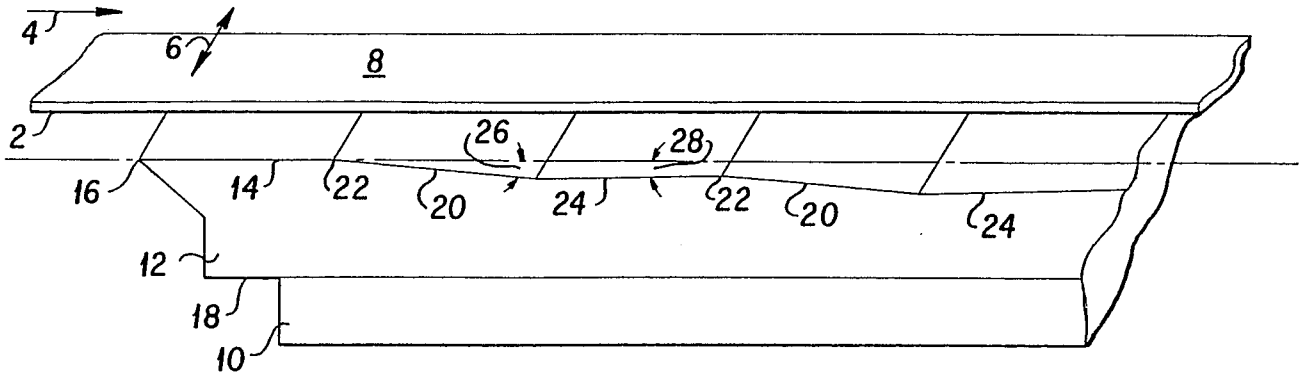
FIG. 1 is a diagrammatic representation of one embodiment of the present invention.

The embodiment of the invention which is illustrated in FIG. 1 is one which is particularly suited for achieving the objects of this invention. FIG. 1 diagrammatically depicts a portion of the forming section of a paper making machine of the type wherein a forming medium 2 receives stock from a headbox at a first end (not shown) and transfers a substantially self-supporting paper web from the forming medium 2 at a second end (not shown), the forming medium travelling in the machine direction generally designated by arrow 4. Hydrofoil blades are provided beneath the forming medium 2. The hydrofoil blades extend in the cross machine direction relative to the forming medium, the cross machine direction generally designated by arrow 6. The functions of hydrofoil blades are to drain water through the forming medium 2 while the paper web 8 is being formed on the forming medium and to form the paper web. In the present invention, a hydrofoil support or box 10 is provided which includes at least a first hydrofoil blade 12 comprising a forming medium bearing portion 14 having a leading edge 16 and a lower portion 18 spaced from the forming medium bearing portion. At least one dewatering surface 20 diverges downward towards the lower portion 18 from a respective of at least one crease line 22. At least one vacuum decay-turbulence generating planar surface 24 diverges upward from a respective dewatering surface 20 to a respective of at least one other crease line 22.

In operation, the forming medium 2 first contacts the multi-step hydrofoil blade in a manner familiar to those skilled in the art of papermaking at the forming medium bearing portion which is oriented parallel to and is fully in contact with the forming medium. Dewatering of the stock forming paper web 8 is initiated by the vacuum created in the nip formed over the first surface 20 immediately following the bearing portion 14, the surface 20 being inclined slightly away from a plane in which the forming medium bearing portion 14 extends in the direction 4. For example, the angle of inclination 26 of the surface 20 away from the forming medium is small, somewhere between 0.1 degrees and 5 degrees.

In the preferred embodiment, the initial contact portion 14 and inclined surface 20 of the multi-step foil blade have a length of the same order-of-magnitude, usually between about 3 and 10 cm. The surface 24 immediately following the inclined surface 20 has a smaller angle of inclination, relative to the plane in which the forming medium bearing portion lies, than the surface 20. For example, in the embodiment of FIG. 1, surface 24 is inclined upward towards such plane at a small angle 28 in the direction of travel 4. One or more pairs 20, 24 may be provided in hydrofoils contemplated by the present invention. The purpose of the section of the foil blade above each surface 24 is not to cause dewatering, but rather to permit the vacuum generated in the dewatering section above the surface 20 immediately ahead of it to decay and to generate turbulence of controlled scale and intensity in the stock above the forming medium by forcing a small proportion of the water removed from it through the forming medium back up through the forming medium and the partially-formed web, thereby creating a floc-dispersing, turbulance-generating pressure pulse.

Figure 2:
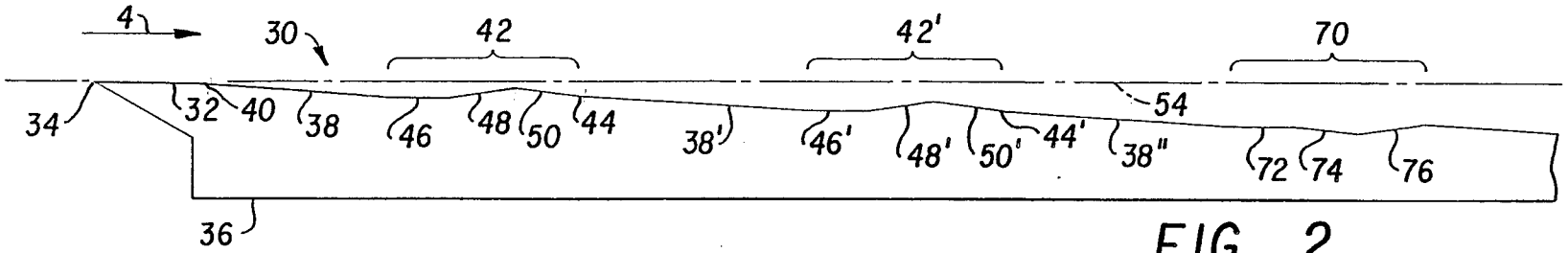
FIG. 2 is a partial view of a diagrammatic representation of another embodiment of the present invention.

In an alternative embodiment of the present invention as depicted in FIG. 2 a hydrofoil blade 30 is provided comprising a forming medium bearing surface 32 having a leading edge 34 and a lower surface 36 spaced from the forming medium bearing surface. At least one dewatering surface 38 diverges downward towards the lower surface 36 from a respective of at least one crease line 40. At least one intermediate surface 42 extends from a respective dewatering surface 38 to a crease line 44. Each intermediate surface includes in tandem in the machine direction (a) a vacuum decay surface 46 extending from a dewatering surface 38; (b) a turbulence generating surface 48 extending upward away from lower surface 36 from the vacuum decay surface 46; and, (c) a trailing surface 50 extending from the turbulence generating surface 48 to crease line 44.

Although not necessary, additional combination dewatering/intermediate surfaces can be provided at a location downstream of the combination dewatering surface 38/intermediate surface 42. Such additional combination(s) can be provided immediately adjacent to or even further downstream of the combination dewatering surface 38/intermediate surface 42. For example, in FIG. 2 a similar combination dewatering surface 38'/ intermediate surface 42' is provided. In such embodiment, surface 38' would again provide a dewatering section like that above surface 38. This dewatering section would be followed by another turbulence generating section 42', including sub-sections 46' 48', 50', whose orientation to the forming medium 2 in the direction 4 would be like that of those of 42, or 46, 48, 50, except that the surface or surfaces would be displaced downward away from the forming medium 2 due to the intervening presence of the downwardly inclined (in the direction 4) dewatering section 38'. The total number and location of successive pairs of dewatering and turbulence generating sections would be governed by the weight of the sheet being produced, the amount of water that has to be removed from the stock suspension, and by the physical size of the beam on which the multi-blade foil is mounted. Thus, for example, a given multi-blade foil might consist of two to eight pairs of dewatering and turbulence generating sections.

Figure 4:
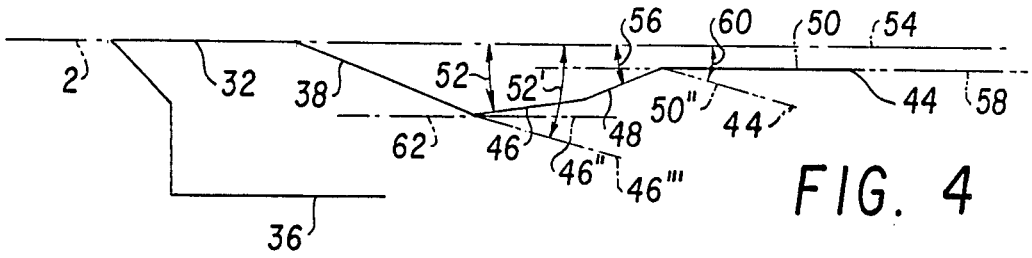
FIG. 4 is a partial diagrammatic representation of the embodiment of FIG. 2 but depicting various alternative surface orientations.

The angular orientation of surfaces 46 and 50 can be varied as desired, and FIG. 4 schematically depicts such variation. For example, as depicted in FIG. 4, vacuum decay surface 46 extends upward at a first angle 52 relative to a first plane 54 of forming medium bearing surface 32 away from the lower surface 36. First plane 54 of forming medium bearing surface 32 is defined to mean a plane in which surface 32 lies as schematically depicted in FIG. 4. The turbulence generating surface 48 diverges upward at a second angle 56 relative to first plane 54 away from the lower surface 36. In the embodiment of FIG. 4 the trailing surface 50 extends in a second plane schematically represented at 58 which is parallel to first plane 54. Alternatively, the trailing surface extends, as depicted at 50'', downward at a third angle 60 relative to plane 54 towards lower surface 36.

Regardless of whether trailing surface 50 extends in a second plane 58 which is parallel to the first plane 54 or extends, as depicted at 50'', downward at a third angle 60 relative to plane 54, at a smaller angle to plane 54 then the angle of the preceding dewatering surface zone 38, a vacuum decay surface can be provided which as depicted at 46'', extends in a plane schematically represented at 62 which is parallel to plane 54, or which extends, as depicted at 46''', downward at an angle 52' relative to plane 54 towards lower surface 36.

By further way of example, and without limitation, the first sub-sections 46 of the intermediate surface 42 might be (a) oriented downward at a smaller angle 52' than surface 38, such as 0.5 degrees to 1.0 degree; (b) oriented parallel to the plane of the forming medium bearing surface 32; or (c) inclined upward at a small angle 52 relative to the plane of forming medium bearing surface 32 in the direction of travel 4 of between 0.1 degree and 5 degrees. In case (a), the vacuum created in the preceding section above the surface 38 will diminish in the sub-section above the subsurface 46; in (b), the vacuum in sub-section 46 will decay virtually completely; and in (c), the vacuum will decay and some white water will be forced back up through the forming fabric to cause a small pressure pulse.

The sub-section 48 of the turbulence generating zone immediately following sub-section 46 is inclined upward at a small but greater angle 56 relative to the plane of the forming medium bearing surface in the direction 4 than the surface of the preceding sub-section 46 to generate turbulence in the unformed stock above the partially-formed web. The larger its upward angle in the direction 4 relative to the forming medium bearing surface 32, the more intense the turbulence generated, and vice versa. The greater the length of this inclined surface 48, the larger the scale, or the greater the distance over which the turbulence is applied. For example, an inclined length for surface 48 or one cm. long and having an angle of 0.5 degree would generate a small weak pulse, whereas an inclined length of one cm. long but with an angle of 1.5 degrees would generate a much more intense pressure pulse.

These dimensions are provided merely as examples, and the angle and length of an inclined sub-section 48 required to produce a turbulence pulse of a given scale and intensity on a given papermachine depend on several factors such as the operating speed of the papermachine, the thickness of the layer of stock to be kept dispersed, and the thickness and density of the partially-formed web which acts as a resistance or dampener to the applied pressure pulse. The faster the machine, and the thinner the stock layer and partially-formed web, the less energy is required to produce a turbulence pulse of the desired scale and intensity, and so the shorter and shallower the inclined section, and vice versa.

The sub-section 50 following the turbulence generating subsection 48 might be oriented parallel to the forming medium bearing surface, or it may have a small angle 60 of inclination away from the forming medium bearing surface in the direction 4 to reinitiate dewatering and/or to bring the fabric-to-blade surface distance of separation at the end of the sub-section 50 to the same height as it was at the beginning of the sub-section 46. In this case, there would essentially be no gain or loss in the amount of water removed from the stock by dewatering across the blade section 46, 48, 50.

In a further embodiment of the present invention as depicted in FIG. 2, a hydrofoil blade is provided comprising at least one turbulence generating area 70 including in tandem in the machine direction, a vacuum decay section 72 extending from a dewatering surface such as surface 38'', and a turbulence generating section including a first surface 74 diverging downward towards lower surface 36 from the vacuum decay section 72 and a second surface 76 diverging upward away from such lower surface from the first surface 74. In a preferred form, a surface 72 of the subsection of the turbulence generating area 70 might be parallel to plane 54 to permit the vacuum generated over the surface of a preceding dewatering section 38'' to decay. The following turbulence generating surface formed by surfaces 74 and 76 would then be in the form of a V, with the first surface 74 inclined towards lower surface 36 in the direction 4, and the second surface 76 away from it. The greater the intensity of the turbulence desired, the larger the angles of the surfaces 74 and 76 relative to the plane 54 and the greater its desired scale, the greater their length, and vice versa.

The number of sub-sections of a turbulence generating section such as 42, 42', or 70 is not limited to three subsections, but may include more or less of such subsections, each of which includes surfaces, as discussed above, individual of such surfaces being at the same or a slightly different small angle relative to the plane 54 as discussed above.

Figure 3:
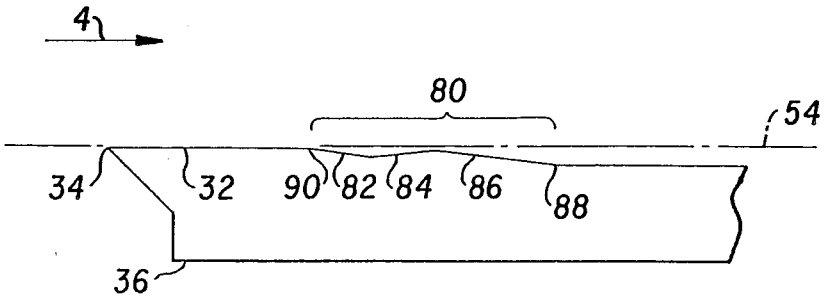
FIG. 3 is yet another partial view of a diagrammatic representation of another embodiment of the present invention.

The division of the surfaces of the multi-blade foil into turbulence generating surfaces or portions is not limited to the vacuum decay zones such as the surfaces 42 and 42'. For example, a dewatering surface can be replaced with the surfaces or portions which comprise the surface 80 as schematically shown in FIG. 3. For example, surface 80 can be sub-divided in a similar manner into portions 82, 84 and 86, with the one additional stipulation that the last portion 86 have an angle of inclination away from the plane 54 in the direction 4 of such a size that the distance of separation of its end point 88 below the plane 54 is greater than that of front end 90 of its initial portion 82. The greater the height difference between these two gaps, that is between the point 90 of FIG. 3 in the plane 54, and between the point 88 below the plane 54, and more dewatering is obtained across the dewatering zone provided at portions 82, 84, 86. The particular hydrofoil blade of this embodiment includes at least one surface 80 generally diverging downward towards lower surface 36 from a respective crease line at front end 90. At least one of such surfaces includes in tandem in the machine direction, a dewatering surface 82 diverging from a respective crease line, a vacuum decay/turbulence generating surface 84 diverging upward from dewatering surface 82 away from lower surface 36, and trailing surface 86 diverging downward from the vacuum decay/turbulence generating surface 84 towards lower surface 36 to another crease line at end point 88. In this embodiment, the crease line at end point 88 lies between the immediately preceding crease line at front end 90 and lower surface 36.

Figure 5:
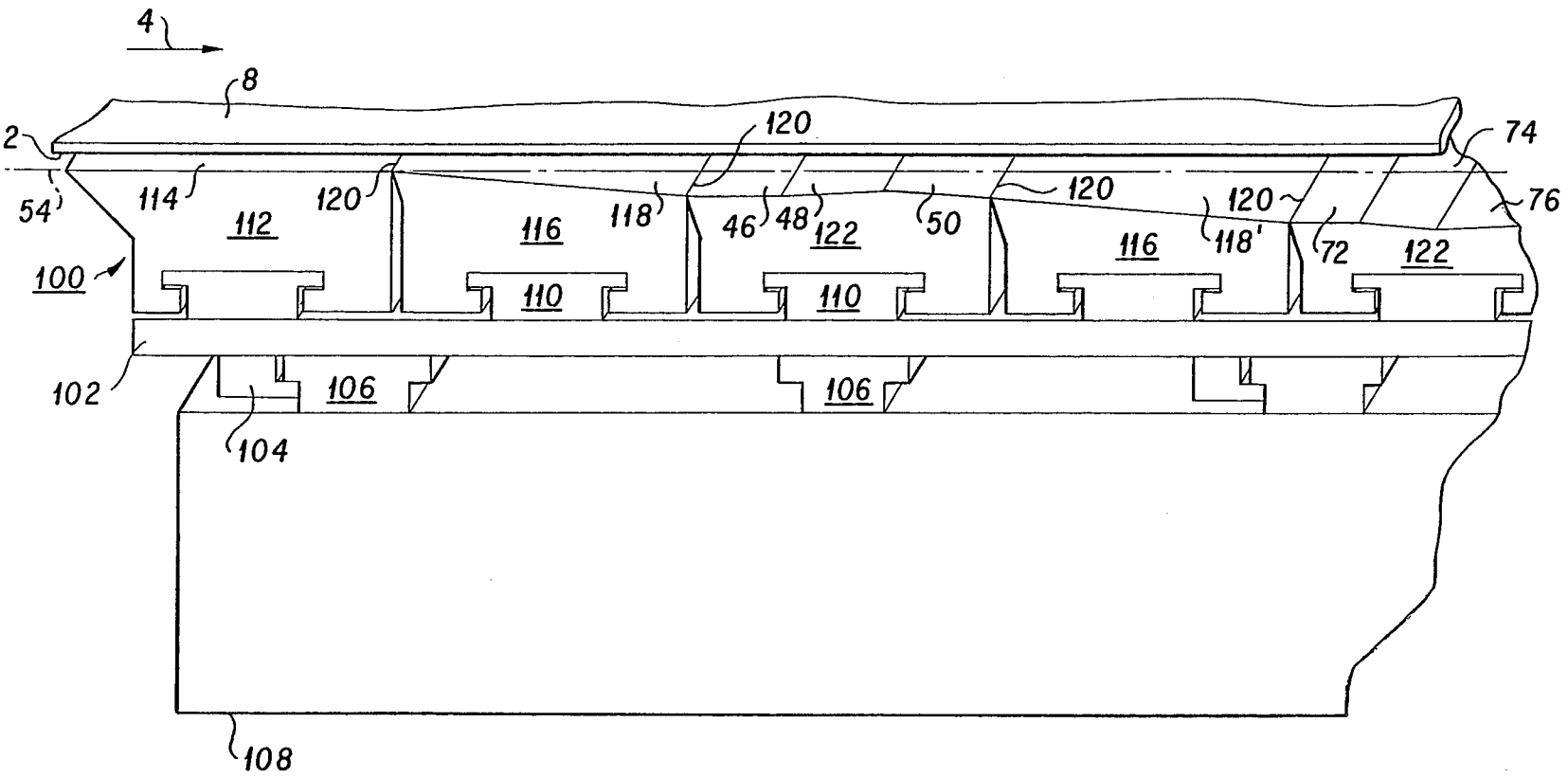
FIG. 5 is another partial view of a diagrammatic representation of another embodiment of the present invention.

Another embodiment of a turbulence-generating multi-blade foil of the present invention is shown in FIG. 5. The base of the hydrofoil blade 100 is a steel plate 102 with high density, high molecular weight polyethylene half-tees 104 attached to its lower surface affixing it to at least two conventional tees 106 of a conventional foil beam 108.

A set of steel tees 110 is affixed to the top surface of the plate 102 at equidistant spacing along its length in the direction 4. The foil blade 112 mounted on the first tee provides the contact surface 114 comparable to, for example, forming medium bearing surface 32. The hydrofoil blade 116 mounted on the next downstream tee provides the first dewatering surface 118 comparable to, for example, dewatering surfce 38. The leading edge of blade 116 is in contact with the trailing edge of blade 112 at cross machine direction crease line 120.

Several sets of hydrofoil blades 116 are provided. The first set of such blades all have the same height between the steel plate 102 and the crease line 120 but have different descending angles in the direction 4 away from the plane 54 between 0.1 degree and 5 degrees to provide different rates of dewatering in the first dewatering section. The several blades of each of the other sets have the same series of angles. However, the overall height between the top surface of the steel plate 102 and their respective leading edge 120 of each of these sets is slightly different, about a fraction of a millimeter or a few millimeters, for their use at successive locations in blade positions 116 where the vertical gap between plane 54 and the leading edge of the dewatering blades increases stepwise due to the presence of dewatering blades upstream.

In like manner, several turbulence generating hydrofoil blades 122 with surface configurations like, for example, 46, 48 and 50 and 72, 74 and 76, of FIG. 2, are provided for each of the turbulence generating areas at blades 122. Again, the overall height of the blades of each set, that is, the gap equal to the distance between the equivalent leading edge or crease line 120 and the top surface of the support plate 102 differs slightly, such as, a fraction of a millimeter or a few millimeters among the different sets for their use at successive locations downstream on the support plate.

It will be apparent from the foregoing and from FIG. 5 that a hydrofoil blade is provided which comprises a plurality of separate segments such as, for example, 116 and 122, each of which is composed of one or more surfaces such as, for example, forming medium bearing surface 14, 32, 114, dewatering surface 20, 38, 82, 118, vacuum decay surface 46, 72, turbulence generating surface 48, 74, trailing surface 50, 76, 86, and vacuum decay-turbulence generating surface 24, 84. By selectively assembling such segments as depicted, for example, in FIG. 5, a hydrofoil blade having the desired characteristics can be provided. It should be emphasized that any desired combination of segments can be provided.

Figure 6:
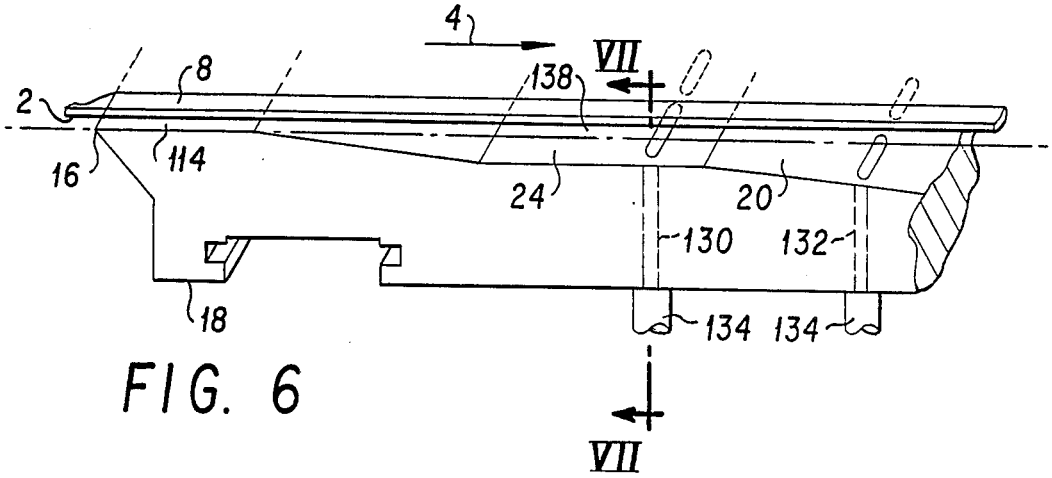
FIG. 6 is yet another partial view of a diagrammatic representation of another embodiment of the present invention; and, FIG. 7 is a section of FIG. 6 take along lines 7—7.
Figure 7:
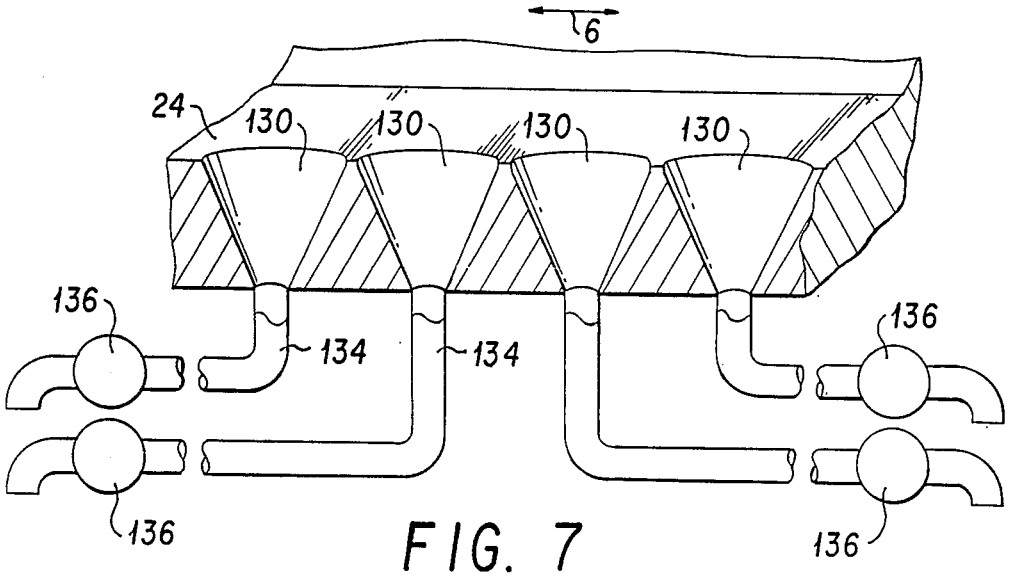

Another form of a turbulence-generating multiblade hydrofoil is shown in FIGS. 6 and 7. These Figures show a blade, as for example of the type depicted in FIG. 1, wherein the generation of turbulence is facilitated at points along the length of the blade by the selective removal of small, controlled amounts of water across the width of the papermaking machine. This water is removed from the surfaces 20, 24 of the blade through small channels 130, 132 cut into it. These channels are tapered downwardly in the cross machine direction plane 7—7 of FIG. 6 as shown in FIG. 7 to effect uniform or controllable removal of water. The lower end of the tapered channels feed tubes 134 which extend in the cross direction of the machine to its front and back side where valves 136 control the rate of their discharge into the wire pit (not shown). In operation, the downward removal of water through the channels 130, 132 from the small space 138 between the forming medium and the surfaces 20, 24 creates a small downward force on the fabric. When this force on the fabric is terminated by its travel in the machine direction 4 past a respective channel, such a downward force decays instantly, and allows the forming medium to spring back upward to its original plane of travel. This upward spring of the fabric causes stock jump or turbulence in the same manner as the instantaneous decay of the vacuum force created by conventional foil blades.

The purpose of the valves 136 in the discharge lines 134 of the channels is to be able to control the rate of dewatering across the machine. Such regulation provides the papermaker with an additional profiling tool to control the cross-directional moisture profile of the sheet of paper.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A hydrofoil blade for use in a paper making machine of the type wherein hydrofoil blades are positioned beneath a forming medium and extended in the cross machine direction relative to said forming medium for draining water through said forming medium while a paper web is being formed on said forming medium and for forming said paper web, said hydrofoil blade comprising a plurality of separate and distinct surfaces including a forming medium bearing surface lying in a first plane and having a leading edge, a lower surface lying in a second plane and spaced from said forming medium bearing surface, at least one dewatering surface diverging downward towards said lower surface from a respective of at least one crease line, and at least one intermediate surface extending from a respective of said at least one dewatering surface to a respective of at least one other crease line, each of said at least one intermediate surface including in tandem in the machine direction (a) a vacuum decay surface extending from said at least one dewatering surface, (b) a turbulence generating surface extending upward from said vacuum decay surface and upwardly of said lower surface, and (c) a trailing surface lying in a third plane and extending from said turbulence generating surface to said at least one other crease line, said third plane lying between said first plane and said second plane.

2. The hydrofoil blade of claim 1 wherein in at least one of said at least one intermediate surface, said vacuum decay surface extends upwardly of said lower surface at a first angle relative to said first plane and said turbulence generating surface diverges upward at a second angle different from said first angle relative to said first plane.

3. The hydrofoil blade of claim 2 wherein in at least one of said at least one intermediate surface said third plane is parallel to said first plane.

4. The hydrofoil blade of claim 2 wherein in at least one of said at least one intermediate surface said trailing surface extends downward at a third angle relative to said first plane towards said lower surface.

5. The hydrofoil blade of claim 1 wherein in at least one of said at least one intermediate surface, said vacuum decay surface extends in a fourth plane which is parallel to said first plane.

6. The hydrofoil blade of claim 5 wherein in at least one of said at least one intermediate surface said third plane is parallel to said first plane.

7. The hydrofoil blade of claim 5 wherein in at least one of said at least one intermediate surface said trailing surface extends downward relative to said first plane towards said lower surface.

8. The hydrofoil blade of claim 1 wherein in at least one of said at least one intermediate surface said vacuum decay surface extends downward relative to said first plane towards said lower surface.

9. The hydrofoil blade of claim 8 wherein in at least one of said at least one intermediate surface said third plane is parallel to said first plane.

10. The hydrofoil blade of claim 8 wherein in at least one of said at least one intermediate surface said trailing surface extends downward relative to said first plane towards said lower surface.

11. The hydrofoil blade of claim 1 wherein said hydrofoil blade comprises a plurality of segments, each of said segments being composed of one or more of said surfaces.

* * * * *